United States Patent [19]

Plitz

[11] 4,317,526

[45] Mar. 2, 1982

[54] SAFETY CLOSURE CAP

[76] Inventor: Gernot Plitz, 310 E. 52nd St., New York, N.Y. 10022

[21] Appl. No.: 182,733

[22] Filed: Aug. 29, 1980

[51] Int. Cl.[3] ..... B65D 55/02

[52] U.S. Cl. ..... 215/217; 215/223

[58] Field of Search ..... 215/217, 223, 218, 318

[56] References Cited

U.S. PATENT DOCUMENTS 3,952,899 4/1976 Cooke ..... 215/217

4,190,171 2/1980 Kulle et al. ..... 215/318

4,275,817 6/1981 Patton ..... 215/222

*Primary Examiner*—George T. Hall

*Attorney, Agent, or Firm*—Wolder, Gross & Yavner

[57] ABSTRACT

A safety closure cap includes a top cover; a generally cylindrical skirt member downwardly extending from the top cover; and a flexible arcuate lip provided on the interior surface of the skirt, the lip having a leading and trailing edge in close proximity to each other.

7 Claims, 8 Drawing Figures

SAFETY CLOSURE CAP

BACKGROUND OF THE INVENTION

The present invention relates generally to closure caps for bottle containers having a threaded neck portion onto which the cap is intended to fit. More specifically, the invention is directed to a safety type closure cap, commonly referred to as a child resistant cap, in order to render difficult opening of the container by children or infants so as to prevent access to the container, which may contain harmful ingredients if ingested by the child.

The prior art contains many suggestions for safety closure caps. Such devices usually require a special manipulative procedure sufficient to render removal of the cap difficult for most children. The special manipulative procedures usually involve two separate actions to remove the cap. For example, a rotating movement of the cap simultaneously with downward pressure is one such type of special manipulative procedure. Similarly, the prior art has provided structure which requires squeezing the sides of the cap while simultaneously twisting in order to be able to remove the cap.

Most standard bottle containers are usually provided with a single spiral thread at the neck portion to accomodate a twist-on cap. In order to provide a safety or locking closure feature, it has heretofore been necessary to modify the standard neck portion of such bottle containers by adding lug structure, camming arrangements, or other modifications to accomodate a specially designed interlocking cap with elements which will engage such lug members, or camming arrangements. The special manipulative procedures would be required to overcome the locking arrangement. Such safety closure arrangements, therefore, require use of a specially designed cap with a compatible neck portion. Accordingly, the prior devices have required not only a special design for the cap itself, but a compatible design for the neck portion of the container. Use of a specially designed cap on a standard bottle type closure having the traditional spiral thread would not be capable of achieving the safety feature. Only when the cap is used in conjunction with an appropriately designed and structured neck portion could the safety feature be implemented. A universally adaptable closure cap for use on a standard container having the standard neck portion, and interchangeable with other standard containers, has thus far not been achieved.

Examples of the prior art in which a specially designed cap is used in conjunction with a compatible neck portion are shown in U.S. Pat. Nos. 3,888,376; 3,941,261; and 4,117,945. Reference to other prior devices similarly requiring compatibly designed caps and closure necks are contained in the foregoing U.S. Patents.

The safety closure cap of the present invention is of the type which permits continued rotatable movement of the cap while preventing removal of the cap unless and until two separate and simultaneously applied movements are applied, and without involving locking the cap onto the container neck.

It will be appreciated from the foregoing referenced prior art that the safety closure feature can only be accomplished by a modification of the standard neck arrangement so as to be compatible with a specially designed cap. In one arrangement of the prior art, cooperating shoulder portions having camming surfaces must be provided on the cap and the neck portion of the container for an appropriate interlocking arrangement. Similarly, the other prior art also requires cooperating camming or lug arrangements on both the cap and the neck portion of the container in order to provide the interlocking arrangement which requires the two separate and simultaneously applied movements in order to release the cap.

While prior U.S. Pat. No. 3,425,978 discloses a cap structure for possible use on a standard neck portion of a container provided with the typical single spiral thread, this structure is not of the safety or child resistant type which would require two separate manipulative movements to remove the cap. Rather, this type of prior art involves the use of an interlocking thread on only one of the members (cap or neck) which would engage the standard thread on the other member. However, this arrangement merely provides for a locking feature which can be overcome by sufficient force applied in a rotating direction.

It is accordingly a principal object of the present invention to provide a safety closure cap which overcomes the disadvantages of the prior art, and which can be universally used on standard bottle containers.

A more specific object of the present invention is to provide a safety type closure cap, commonly referred to as a child resistance cap, requiring both an axial and simultaneously rotatable movement of the cap in order to remove the cap from the container. The present invention also requires an oppositely directed axial movement and simultaneously applied oppositely directed rotatable movement to place the cap in a safety closure condition on the neck of the container.

Yet a further specific object of the present invention is to provide a simple design for a safety closure cap which can be used interchangeably on most standard bottle necks without requiring modification to the standard neck, or special cooperating lugs or cam elements on the standard bottle neck.

SUMMARY OF THE INVENTION

The foregoing objects of the present invention are generally accomplished by providing a safety closure cap which includes a top cover; a generally cylindrical skirt member downwardly extending from the cover; and a flexible arcuate lip provided on the interior surface of the skirt, the lip having a leading and trailing edge in close proximity to each other.

Other objects, features and advantages of the present invention will become more apparent from the detailed description of the invention in connection with the accompanying drawings to be described more fully hereinbelow.

DESCRIPTION OF THE INVENTION

Figure 1:
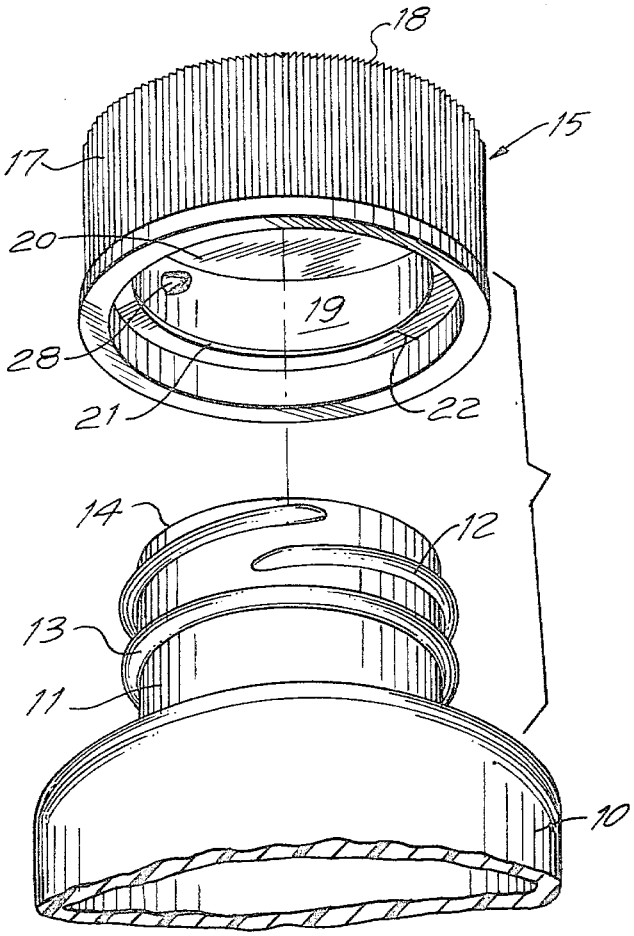
FIG. 1 is an exploded perspective view illustrating the safety closure cap of the present invention spaced from a standard neck of a container.
Figure 2:
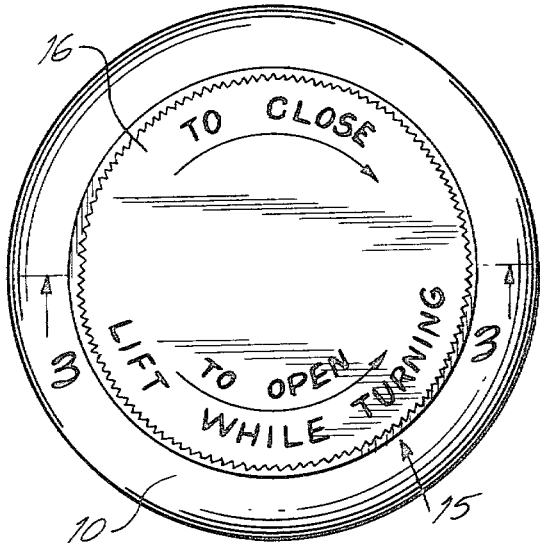
FIG. 2 is a top plan view of the cap of the present invention shown on the container.

Referring now in more detail to the accompanying drawings, a standard bottle type container 10 having a neck portion 11 is illustrated in FIG. 1. The neck portion 11 of the typical standard bottle container is provided with a spiral thread 12 on an exterior surface thereof in order to accomodate a twist-on closure cap. A circumferential lip 13 is also typically provided on most standard bottles as a limiting stop.

The cap of the present invention, generally referred to by reference numeral 15 includes a top cover 16 and a cylindrical skirt 17 downwardly depending from the top cover 16. The exterior cylindrical surface of the skirt 17 may be provided with ridges or a knurled surface 18 so as to provide a non-slip surface to facilitate gripping. The internal cylindrical surface 19 of the skirt 17 carries an arcuately shaped lip or ledge member 21.

Figure 6:
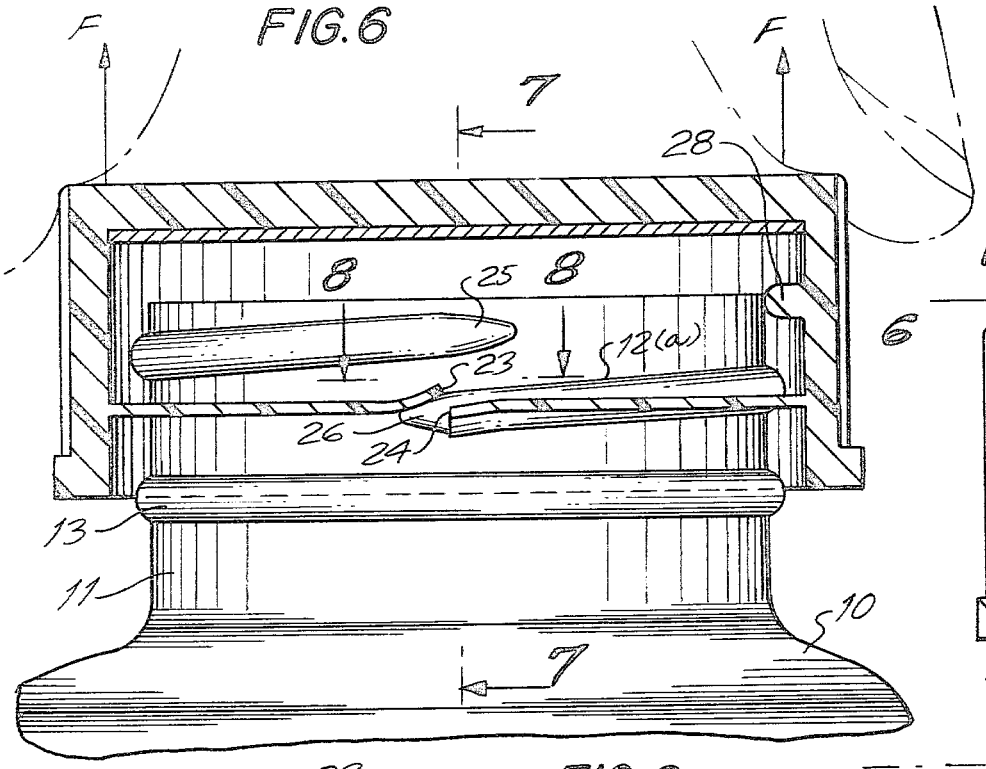
FIG. 6 is a sectional view taken along lines 6—6 of FIG. 7 and illustrating the position of the safety cap being manipulated for removal from the container and for initiating an unlocking condition.
Figure 7:
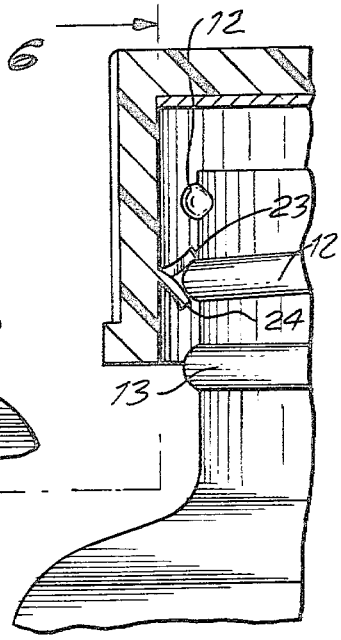
FIG. 7 is a sectional view taken along lines 7—7 of FIG. 6.
Figure 8:
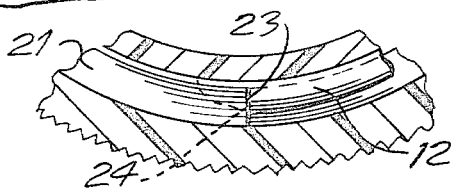
FIG. 8 is a sectional view taken along lines 8—8 of FIG. 6.

The ledge member 21 has a radially arranged slit 22 defining leading and trailing edges 23 and 24, respectively, which can be more fully appreciated from FIG. 6. The leading and trailing edges 23 and 24 may be slightly spaced apart.

It is an essential feature of the present invention that at least a portion of the ledge 21 adjacent both the leading and trailing ends be sufficiently flexible to engage the leading and trailing ends of the spiral thread 12 in the manner illustrated in FIG. 6 so that the cap 15 can be twisted on or off the container. The remainder of the ledge 21 may be sufficiently rigid to prevent axial removal of the cap from the container as a result of the ledge 21 engaging the underside surface of the spiral thread 12 when no twisting or rotational movement is applied.

In order to remove the cap of the present invention from the standard bottle, it is necessary to exert an upward axial force on the cap, as illustrated in FIG. 6, by arrows "F", and a simultaneous twisting or rotational movement in a counterclockwise direction as viewed in FIG. 1, so that the leading edge 23 of ledge 21 will engage the trailing end 26 of thread 12 and ride onto its upper surface 12(*a*). Continued rotational movement without further upward axial movement will cause the cap to unscrew from the neck of the container 10.

In order to place the cap of the present invention onto the standard bottle type container to achieve the safety condition, the cap is placed over the open end 14 of the container until the undersurface of the ledge 21 engages the top surface of spiral thread 12. The cap will then be twisted in a clockwise direction (as illustrated in FIG. 1) and an axial downward force (in a direction opposite to arrows "F" of FIG. 6) will be simultaneously applied to the top of the cap until the leading end 25 of the spiral 12 engages the slit 22 (or other spacing between the leading and trailing edges 23, 24 of the ledge 21). The downwardly applied axial force will cause trailing edge 24 to be moved underneath the leading end 25 and ride along the lower surface 12(*b*) of spiral thread 12. Continued clockwise rotational movement will result in screwing the cap onto the neck until the slit 22 rides off the trailing end 26 of the spiral thread 12. At this point, the condition illustrated in FIG. 5 will have been achieved. Thus, the entire ledge 21 will be positioned beneath the thread 12 and any upward movement will prevent removal of the cap from the neck unless the trailing end 26 engages slit 22 so that the leading edge 23 will ride onto the upper surface 12(*a*) of spiral thread 12.

Figure 5:
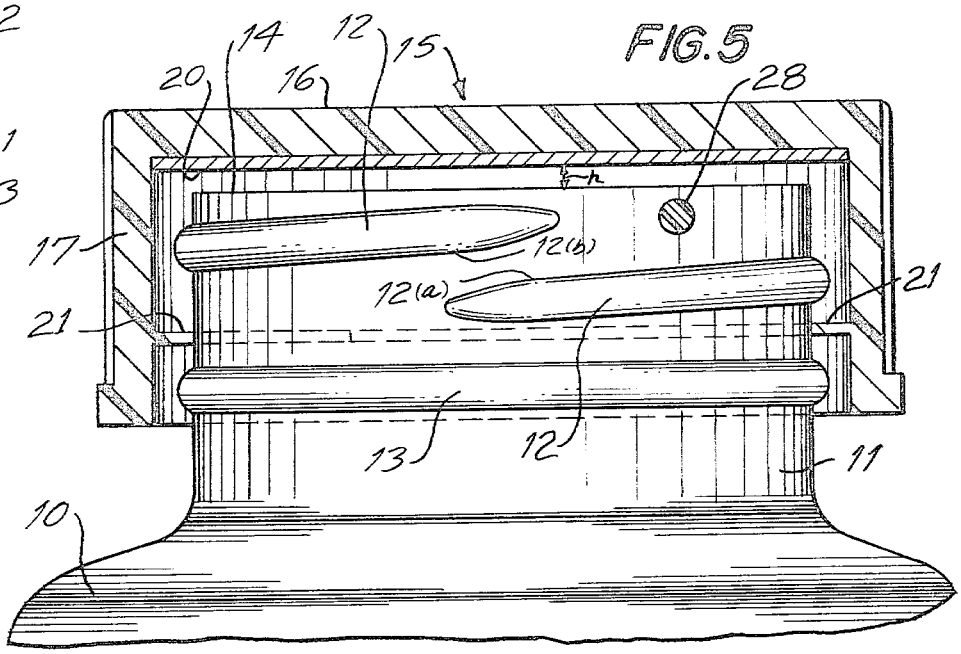
FIG. 5 is a sectional view similar to the view of FIG. 3 illustrating the cap of the present invention in a safety condition.

In the condition illustrated in FIG. 5, the ledge 21 is illustrated as abuting against the lower surface of spiral thread 12. In this condition, space "h" exists between the undersurface 20 of cover 16 and the top of the opening 14. Simple rotational movement will not result in any removal of the cap. Removal can only be achieved by applying a simultaneous upward force and a counterclockwise rotational movement, as illustrated in FIG. 6.

Figure 4:
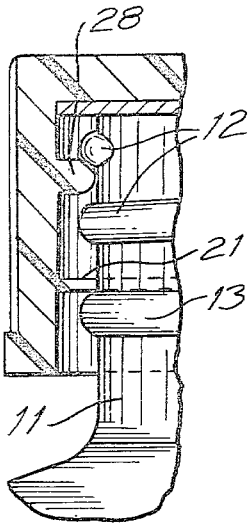
FIG. 4 is a partial sectional view taken along lines 4—4 of FIG. 3.

FIG. 4 illustrates the condition in which the ledge 21 abuts against the stop lip 13. In this condition, the top 14 of the container will abut against the undersurface 20 of top cover 16.

A further feature of the present invention is the provision of inwardly extending detent member 28 carried on the inner surface 19 of skirt 17. As illustrated in FIGS. 4, 5 and 6, detent 28 is arranged for engagement between oppositely facing upper and lower surfaces 12(*a*) and 12(*b*), respectively, of the spiral thread 12, in order to provide means for sealing the open top 14 of the container against the undersurface 20 of the top cover 16.

Figure 3:
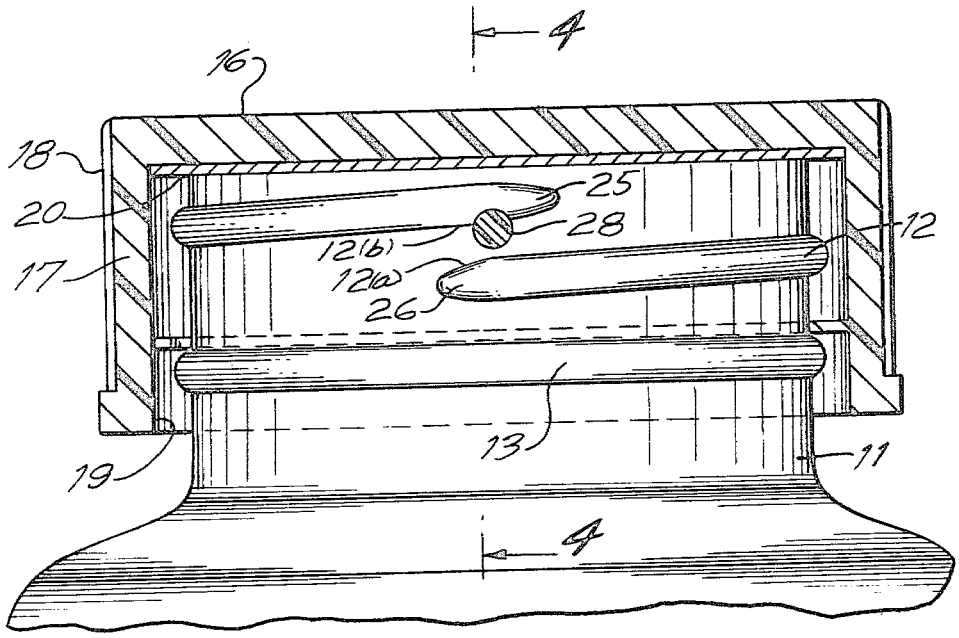
FIG. 3 is a sectional view taken along lines 3—3 of FIG. 2 illustrating the cap in closed position on the container in a sealed position.

As illustrated in FIG. 5, when ledge 21 is positioned directly beneath thread 12, detent 28 will be in a non-engaged position. Continued rotation of the cap will cause detent 28 to be repositioned between the upper and lower surfaces 12(*a*), 12(*b*) of the sprial thread 12, as illustrated in FIGS. 3 and 4. As a result of detent 28 being guided between upper and lower surfaces of the spiral thread, the cap will be forced axially downward onto the container neck until a sealed condition is achieved. Unsealing is simply achieved by rotating in an opposite direction.

While the present invention has been described and illustrated with respect to a certain preferred embodiment, it will be appreciated by those skilled in the art, after understanding the principals of the present invention, that various changes and modifications may be made, without departing from the spirit and scope of the invention, and it is therefore intended to cover all such changes and modifications in the appended claims.

What is claimed:

1. A safety closure cap comprising a top cover, a generally cylindrical skirt member downwardly extending from said top cover, and an arcuate lip carried on the interior surface of said skirt, said lip having a leading and trailing edge in close proximity to each other.

2. The safety closure cap according to claim 1 wherein at least a portion of said lip adjacent said leading and trailing edges is flexible to permit axially displacement of said leading and trailing edges to receive a threaded member of a container.

3. The safety closure cap according to claim 2 wherein said lip is of sufficient rigidity to prevent displacement thereof when an axial force is applied thereto.

4. The safety closure cap according to claim 1 further comprising an internally extending detent carried on the interior surface of said skirt for engagement between spiral threads on a container.

5. The safety closure cap according to claim 4 wherein said leading and trailing edges of said lip are spaced apart.

6. A safety closure arrangement comprising a first member having a neck portion and a spiral thread externally carried on said neck portion, said spiral thread having a leading end and trailing end, a cap member adapted to be complimentarily fit with said first member to form a safety closure thereon, said cap member comprising a top cover, a cylindrical skirt member downwardly extending from said top cover, an arcuate lip carried on the interior surface of said skirt member having a leading and trailing edge, said leading and trailing edges being adapted for flexible movement in opposite directions to receive said trailing or leading ends of said spiral thread so that said cap member will engage and be threadedly connected with said first member.

7. The safety closure arrangement according to claim 6 further comprising a detent carried on the internal surface of said skirt and adapted for engagement with said spiral on said neck portion for sealing said cap member with said first member.

* * * * *